United States Patent [19]

Voorhees

[11] Patent Number: 4,870,787

[45] Date of Patent: Oct. 3, 1989

[54] SANDING WHEEL

[76] Inventor: Theodore Voorhees, 331 Greenacres Dr., Anderson, Calif. 96007

[21] Appl. No.: 195,109

[22] Filed: May 16, 1988

Related U.S. Application Data

[63] Continuation-in-part of Ser. No. 899,069, Aug. 20, 1986, Pat. No. 4,744,180.

[51] Int. Cl.[4] ..... B24D 17/00

[52] U.S. Cl. ..... 51/358; 51/364; 51/367; 51/381; 51/382

[58] Field of Search ..... 51/358, 364–372, 51/381, 387, 382, 395, 397, 398

[56] References Cited

U.S. PATENT DOCUMENTS 3,698,141 10/1972 Landmark et al. ..... 51/372

FOREIGN PATENT DOCUMENTS

WO80/00033 1/1980 World Int. Prop. O. ..... 51/381

*Primary Examiner*—Frederick R. Schmidt
*Assistant Examiner*—Maurina Rachuba
*Attorney, Agent, or Firm*—Leonard D. Schappert

[57] ABSTRACT

A cylindrical sanding wheel is provided having top and bottom sections, slots into which the base of a contoured abrasive strip fits and restraints which minimize slippage of the contoured abrasive strip with respect to the cylindrical surface of the sanding wheel.

3 Claims, 2 Drawing Sheets

SANDING WHEEL

CROSS-REFERENCING DATA

This application is a continuation-in-part of application Ser. No. 899,069, filed 8/20/86, of THEODORE VOORHEES for SANDING WHEEL, on which Pat. No. 4,744,180 issued on May 17, 1988.

BACKGROUND OF THE INVENTION

1. Field of the Invention.

The present invention is directed generally toward apparatus designed to increase efficiency during sanding operations, and more specifically toward devices known as sanding wheels.

2. Description of the Prior Art

Previous art in the area of abrasive and sanding devices has included slotted abrasive wheels, dressing tools for gear grinding machines, diamond-coated segmented saw blades and other diamond-coated abrasive tools, including tools formed to a particular contour to assist in grinding an article to the desired contour. More specifically, existing art has included sanding belts which, although relatively easy to replace, are not generally available with contoured surfaces, and tend to have a limited life as a result of the buildup of abrasive dust thereon. Abrasive wheels and discs have also been utilized, but these develop the same problems inherent in any sanding operation, primarily that the buildup of abrasive dust limits the life of such devices. While discs with outer contoured surfaces have been utilized, and while some of these discs have consisted of formed wheels including slots or relieved areas to allow for removal of abrasive dust, such discs are constructed as solid wheels having their outer surfaces contoured, and are not easily repairable.

Further, as each of the units discussed above is used, the contour of the sander changes as a result of the abrasive dust loading the surface, necessitating repair or replacement of the whole wheel or belt. Flapped abrasive sanders have been utilized, but they are unable to follow contours accurately for any period of time. The present invention addresses and solves all of the problems just presented by providing a sanding wheel with a contoured surface and including means for the removal of abrasive dust. It also provides for changing the contour of the surface of the sanding wheel quickly and without modification of the wheel itself. None of the prior art of which applicant is aware has taught a sanding wheel including the unique structure, features and advantages taught herein.

SUMMARY OF THE INVENTION

The present invention includes a head which is substantially cylindrically shaped, with a mounting hole positioned substantially in the center to allow mounting on an armature or shaft. The head has two circumferential slots, one on each side thereof. The head is constructed of top and bottom sections and the slots are so shaped that, while they are positioned on the top and bottom sections of the head, they extend around the edge thereof. The invention further includes a contoured abrasive strip constructed of plastic or other flexible material having abrasive materials on the surface thereof. The contoured strip fits into the slots on the top and bottom sections and along the outer surface of the head and is held in position therein during sanding. The top and bottom sections include serrations adjacent to the slots to hold the sanding strip in position during sanding. Because of the structure utilized, the contoured strip may be vacuum-formed to match any given contour desired, and once abrasive material is attached thereto, may be utilized for sanding contoured surfaces. The areas of contoured strip to which abrasive material is attached are raised and separated with open areas therebetween so that a particular contoured strip will include multiple raised sections, each section having substantially the same contour as the others.

One of the objects of the present invention is to provide a sanding wheel which is inexpensive to construct and versatile in use.

Another object of the present invention is to provide a sanding wheel which is easily removed from a machine upon which it is being used.

A further object of the present invention is to provide a sanding wheel which utilizes removable and replaceable contoured abrasive strips so that the sanding wheel may be used for sanding workpieces of different shapes.

Another object of the present invention is to provide a sanding wheel which is of relatively simple construction so that, should any damage occur thereto, it is easily repairable.

The foregoing objects, as well as other objects and benefits of the present invention, are made more apparent by the descriptions and claims which follow.

DESCRIPTION OF THE PREFERRED EMBODIMENT

The present invention consists of a sanding wheel 21 which utilizes a removable and replaceable contoured abrasive strip 31 positioned thereon to facilitate use with workpieces requiring different contours.

Figure 1:
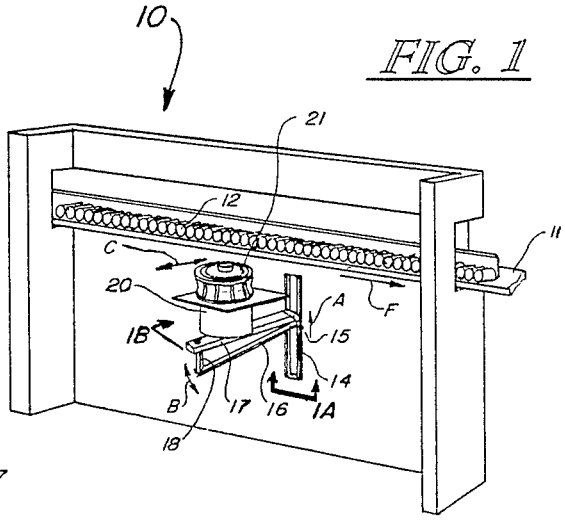
FIG. 1 is a perspective view showing the sanding wheel in position on a machine with which it is being used.
Figure 3B:
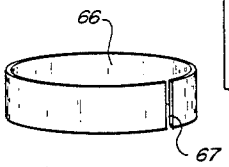
FIG. 3B is a perspective view showing the structure of a ring utilized to center the top and bottom sections of the sanding wheel with respect to each other.

FIG. 1 is a perspective view showing the sanding wheel 21 in position on a processing machine 10. The processing machine 10 includes a set of rollers 12 designed to hold a workpiece 11 in proper orientation as it moves along the path indicated by arrow F. The sanding wheel 21 is mounted on motor 20 so that sanding wheel 21 turns when motor 20 is operated. During operation, a movable support 17 upon which motor 20 is positioned pivots on hinge 15 and is adjusted by adjustment means 18, which in this embodiment consists of a screw or other adjustment means. With proper use of adjustment means 18, the angular position of sanding wheel 21 with respect to workpiece 11 may be adjusted as indicated by arrow B to precisely orient sanding wheel 21 to workpiece 11 as desired. Sanding wheel 21 is raised and lowered by adjustment of slidable support 16, to which movable support 17 is attached, up and down on track 14 as indicated by arrow A. Lateral movement of sanding wheel 21 is achieved by means of a slide arrangement which allows motor 20 to slide laterally along movable support 17 as indicated by arrow C.

Figure 1A:
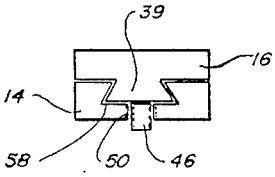
FIG. 1A is a cross-sectional view taken along line 1A of FIG. 1 and showing the structure of the track utilized in raising and lowering the sanding wheel into position.
Figure 1B:
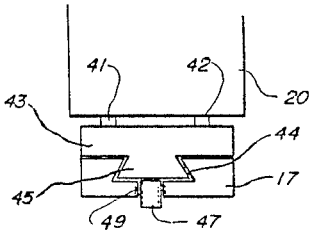
FIG. 1B is a cross-sectional view taken along line 1B of FIG. 1 and showing the track utilized in laterally positioning the sanding wheel.

FIGS. 1A and 1B of the drawings show the structure of the tracks utilized in raising and lowering and laterally moving sanding wheel 21. FIG. 1A, which is taken along line 1A of FIG. 1, shows the structure utilized in raising and lowering sanding wheel 21. Specifically, track 14 has a slot 38 provided therein and a slidable support 16 which includes an extension 39 of substantially the same shape as slot 38 so that slidable support 16 is held in substantially rigid orientation with respect to track 14. When slidable support 16 is set to the desired vertical position, a locking device such as screw 46 extending through threaded hole 50 in track 14 as shown and butting against extension 39 of slidable support 16 is tightened to hold slidable support 16 in position.

FIG. 1B of the drawings shows the track arrangement utilized to allow lateral movement of sanding wheel 21 in the direction indicated by arrow C. Movable support 17 includes a slot 44 positioned therein defining a track very similar to that shown in FIG. 1A. The motor 20 is mounted to a sliding block 43 by means of fastening means 41 and 42. Fastening means 41 and 42 consists of screws in this embodiment, but any other acceptable and reliable fastening means could be employed. Sliding block 43 includes an extension 45 the shape of which is substantially the same as the shape of slot 44 in movable support 17. As a result, motor 20 is held in a substantially rigid orientation with respect to movable support 17. A locking device such as screw 47 extending through threaded hole 49 in movable support 17 and butting against extension 45 of sliding block 43 is provided to lock the lateral position of sanding wheel 21 once the desired position is achieved.

Figure 2:
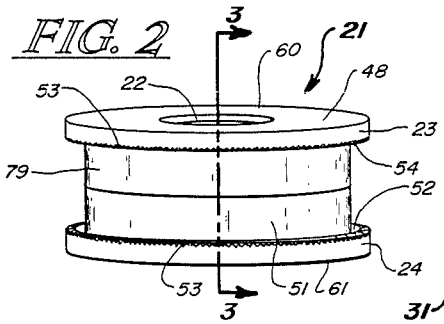
FIG. 2 is a perspective view showing the general structure of the sanding wheel.
Figure 4:
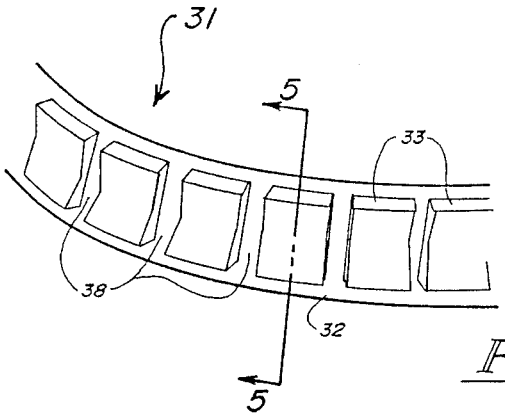
FIG. 4 is a perspective view of the contoured abrasive strip utilized with the sanding wheel.

FIG. 2 of the drawings is a perspective view of sanding wheel 21. The basic structure of sanding wheel 21 consists of a pair of substantially cylindrically shaped body sections 48 and 51 having a top surface 60, a bottom surface 61 and a cylindrical surface 79. A hole 22 is provided substantially concentrically positioned in and extending through body sections 48 and 51 to facilitate attachment to an armature or shaft. A substantially circumferential extension 23 is positioned on body section 48 at the top surface 60 thereof and a second substantially circumferential extension 24 is positioned on body section 51 at the bottom surface 61 thereof. Circumferential extensions 23 and 24 each have a small portion removed to form slots 52 and 54. During preparation of sanding wheel 21 for operation, a contoured abrasive strip 31 as shown in FIG. 4 is positioned in slots 52 and 54 of substantially circumferential extensions 23 and 24 and the cylindrical surface 79 of sanding wheel, 21 substantially covering cylindrical surface 79 of sanding wheel 21. Contoured abrasive strip 31 is held in position because its base 32 is slid into slots 52 and 54, but also by serrations 53, which prevent it from slipping around the cylindrical surface 79 of sanding wheel 21. The operator can remove contoured abrasive strip 31 from sanding wheel 21 by separating substantially cylindrical body sections 48 and 51 from each other, thereby releasing contoured abrasive strip 31.

Figure 3:
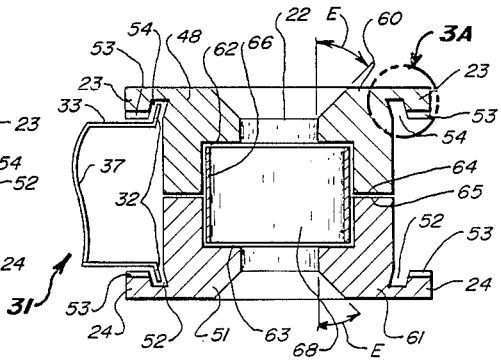
FIG. 3 is a cross-sectional view taken along lines 3—3 of FIG. 2 and showing the structure utilized in preventing the contoured strip from moving during operation of the sanding wheel.
Figure 3A:
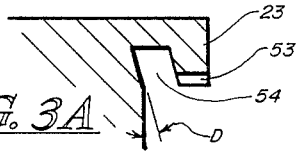
FIG. 3A is an expanded view showing the slot into which the base of the contoured abrasive strip slides.

FIG. 3 is a cross-sectional view of the sanding wheel 21 taken along lines 3—3 of FIG. 2. The sanding wheel 21 has a pair of substantially cylindrically shaped body sections 48 and 51. A substantially flat top surface 60 is provided on body section 48, and a substantially flat bottom surface 61 is provided on body section 51. Body sections 48 and 51 have mating surfaces 64 and 65 respectively which are pressed against each other during use of sanding wheel 21. Sanding wheel 21 further has a hole 22 substantially concentrically located on axis N and extending through body sections 48 and 51 as shown. Hole 22 through body sections 48 and 51 may be chamfered as shown by angles E of approximately 45 degrees at the top and bottom surfaces of sanding wheel 21 to facilitate mounting and centering on a machine. A cavity 68 is provided inside sanding wheel 21 by means of boring a substantially concentrically located hole 63 from mating surface 65 into body section 51 and a substantially concentrically located hole 62 from mating surface 64 into body section 48 as shown. A support ring 66 is positioned inside cavity 68 and is sized and stressed to maintain a tight fit in holes 62 and 63, thereby aligning body sections 48 and 51. The structure of support ring 66 is shown in FIG. 3A. It is slotted at 67 to provide flexibility of fit. Support ring 66 is generally constructed of spring steel or an equivalent structurally strong material capable of aligning body sections 48 and 51.

Sanding wheel 21 also has a pair of circumferential extensions 23 and 24. Circumferential extension 23 bounds cylindrical surface 79 at top surface 60, and circumferential extension 24 bounds cylindrical surface 79 at bottom surface 61. A circumferential slot 54 is provided which extends into circumferential extension 23 from cylindrical surface 79 toward top surface 60 but is angled in toward axis N at an angle D. An angle D of between 15 degrees and 30 degrees was found to hold the contoured abrasive strip 31 effectively in position. As is shown in FIG. 3A, a second circumferential slot 52 is provided which extends into circumferential extension 24 from cylindrical surface 79 toward bottom surface 61 and is angled toward axis N at the same angle as is slot 54 in FIG. 3A.

When the base 32 of contoured abrasive strip 31 is positioned as shown into slots 52 and 54 and body sections 48 and 51 are held tightly together, base 32 is pulled in toward axis N by slots 52 and 54. This forces the ends of raised section 33 against serrations 53, thereby substantially eliminating slippage of contoured abrasive strip 31. Although such is not shown here, contoured abrasive strip 31 extends substantially all the way around cylindrical surface 79.

FIG. 4 of the drawings shows the structure of the contoured abrasive strip 31 in greater detail. Contoured abrasive strip 31 consists of a base 32 with raised sections 33 extending outward therefrom and leaving slots 38 between raised sections 33. Slots 38 between raised sections 33 are important because, without them, saw-dust, chips and other abrasive dust will build up during sanding of a workpiece. Slots 38 prevent loading of the surface of contoured abrasive strip 31 by creating air turbulence and providing an avenue of escape for the abrasive dust so that sanding wheel 21 is self-cleaning, with less wear as a result. When wear does occur, contoured abrasive strip 31 is simply removed from sanding wheel 21 and replaced with a new strip.

Figure 5:
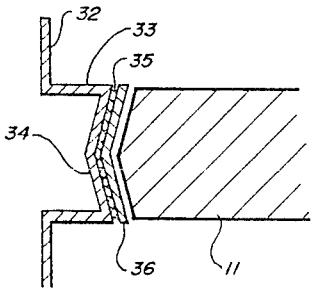
FIG. 5 is a cross-sectional view of the contoured abrasive strip taken along lines 5—5 of FIG. 4.

FIG. 5 is a cross-sectional view of contoured abrasive strip 31 taken along lines 5—5 of FIG. 4. Contoured abrasive strip 31 is constructed of a single sheet of plastic or other formable material, together with abrasive material such as sandpaper. When the sheet of plastic from which contoured abrasive strip 31 is constructed is formed, it results in a base 32 with raised sections 33 as shown. The top surface 34 may be shaped to any desired contour to match the contour of a piece of molding or other material to be sanded. Abrasive material 36 is cut to match the size and shape of the top surface area 34 of raised sections 33 and is attached thereto by adhesive 35. The resulting contoured surface of abrasive material 36 matches the contoured surface of workpiece 11.

Figure 6:
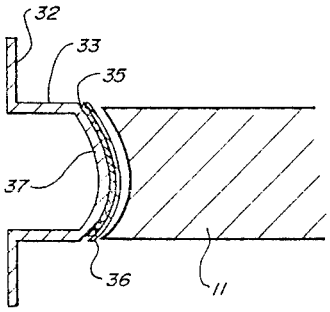
FIG. 6 is a cross-sectional view of the contoured abrasive strip of FIG. 4 taken along lines 5—5, but with an alternative contoured portion.

FIG. 6 is a cross-sectional view of contoured abrasive strip 31 of FIG. 4 taken along lines 5—5 of FIG. 4 and showing an alternative contoured surface which may be utilized. The top surface of raised section 33 is designated 37, but all other numbers remain as in FIG. 5. The contoured abrasive strip 31 may be vacuum-formed and, whether the contour of the surface of abrasive material 36 is concave, as shown in FIG. 5, or convex, as shown in FIG. 6, the contoured abrasive strip 31 works equally well. The key to the operation of contoured abrasive strip 31 and its usefulness is that contoured abrasive strip 31 may be produced inexpensively with extreme accuracy, and may be removed and replaced as desired, depending upon the needs of an operator of sanding wheel 21. Because plastic and/or other formable and somewhat flexible material is utilized in constructing the contoured abrasive strip 31, a certain degree of flexibility is inherent in the strip; this results in less likelihood of damage to the sanding wheel 21, contoured abrasive strip 31 and the workpiece 11 being sanded.

While the foregoing description of the invention has shown a preferred embodiment using specific terms, such description is presented for illustrative purposes only. It is applicant's intention that changes and variations may be made without departure from the spirit or scope of the following claims, and this disclosure is not intended to limit applicant's protection in any way.

I claim:

1. A sanding wheel, having an axis, for use in sanding surfaces utilizing a contoured abrasive strip having a base, comprising:

a substantially cylindrical top section having:
- a top surface:
- a first mating surface;
- a first cylinder surface extending substantially between said top surface and said first mating surface, and
- a substantially circumferential extension extending outward from said first cylindrical surface substantially adjacent to said top surface having a first substantially circumferential slot angled toward said axis of said sanding wheel extending from said first substantially cylindrical surface toward said top surface, further having serrations extending inward toward said axis of said sanding wheel;

a substantially cylindrical bottom section having:
- a bottom surface;
- a second mating surface sized and shaped to mate against said first mating surface of said substantially cylindrical top section;
- a second cylindrical surface of substantially the same diameter as said first cylindrical surface, extending substantially between said bottom surface and said second mating surface, and
- a substantially circumferential extension extending outward from said second cylindrical surface substantially adjacent to said bottom surface having a second substantially circumferential slot angled toward said axis of said sanding wheel and extending from said second substantially cylindrical surface toward said bottom surface, further having serrations extending inward toward said axis of said sanding wheel, and positioning means for holding said first and second mating surfaces of said substantially cylindrical top and bottom sections against each other whereby said contoured abrasive strip having a base of proper size and shape to fit against said first and second cylindrical surfaces and into said first and second substantially circumferential slots is held in position on said sanding wheel during operation thereof.

2. The invention of claim 1, wherein said positioning means consists substantially of a cavity positioned inside of said sanding wheel centered on said axis and a support ring sized and shaped to fit snugly into said cavity, thereby holding said substantially cylindrical top section in position with respect to said substantially cylindrical bottom section.

3. The invention of claim 1, including power means operatively attached to said sanding wheel to turn said sanding wheel on said axis.

* * * * *